US006273093B1

(12) United States Patent
Oliver et al.

(10) Patent No.: US 6,273,093 B1
(45) Date of Patent: Aug. 14, 2001

(54) INCORPORATING SMOKE-MODIFYING AGENTS IN SMOKING MATERIAL RODS

(75) Inventors: Richard Oliver; Anthony Craig Claringbould, both of Southhampton (GB)

(73) Assignee: British American Tobacco (Investments) Limited, London (GB)

( * ) Notice: Subject to any disclaimer, the term of this patent is extended or adjusted under 35 U.S.C. 154(b) by 0 days.

(21) Appl. No.: 09/355,610

(22) PCT Filed: Feb. 13, 1998

(86) PCT No.: PCT/GB98/00460

§ 371 Date: Jul. 30, 1999

§ 102(e) Date: Jul. 30, 1999

(87) PCT Pub. No.: WO98/36650

PCT Pub. Date: Aug. 27, 1998

(30) Foreign Application Priority Data

Feb. 18, 1997 (GB) ..... 9703358

(51) Int. Cl.[7] ..... A24B 15/00; A24C 5/00

(52) U.S. Cl. ..... 131/62; 131/108; 131/110; 131/274; 131/302; 131/304; 131/309; 131/300; 131/306

(58) Field of Search ..... 131/62, 108, 110, 131/274, 302, 304, 309, 300, 306

(56) References Cited

U.S. PATENT DOCUMENTS

| | | | |
|---|---|---|---|
| 3,046,996 | * | 7/1962 | Gary . |
| 3,136,321 | * | 6/1964 | Davis . |
| 3,550,598 | * | 12/1970 | McGlumphy et al. . |
| 3,991,771 | * | 11/1976 | Banks . |
| 4,243,056 | * | 1/1981 | De La Burde et al. . |
| 4,409,995 | | 10/1983 | Nichols . |
| 4,993,434 | * | 2/1991 | Haws et al. . |
| 5,012,823 | * | 5/1991 | Keritsis et al. . |

FOREIGN PATENT DOCUMENTS

| | | | |
|---|---|---|---|
| 1216170 | * | 5/1966 | (DE) ..... 131/62 |
| 38 21 677 A1 | | 1/1990 | (DE) . |
| 0 172 654 A1 | | 2/1986 | (EP) . |
| 0 274 247 A2 | | 7/1988 | (EP) . |
| 0 405 929 A2 | | 1/1991 | (EP) . |
| 0 558 447 A1 | | 9/1993 | (EP) . |
| 1 349 537 | | 4/1974 | (GB) . |
| 2 108 364 | | 5/1983 | (GB) . |

* cited by examiner

*Primary Examiner*—Michael P. Colaianni
(74) *Attorney, Agent, or Firm*—Pitney, Hardin, Kipp & Szuch, LLP

(57) ABSTRACT

A method of, and apparatus for, incorporating particulate smoke-modifying agent in a smoking material rod, wherein said agent is introduced into a flow of filamentary smoking material to the suction band of a rod making machine, the location of introduction being in the vicinity of the suction band of said machine.

21 Claims, 2 Drawing Sheets

INCORPORATING SMOKE-MODIFYING AGENTS IN SMOKING MATERIAL RODS

The subject invention relates to the incorporation of particulate smoke-modifying agents in smoking material rods.

It has heretofore been proposed to incorporate a particulate smoke-modifying agent in a tobacco rod of a cigarette. Thus, for example, it has been proposed in GB 1 349 537 to admix encapsulated flavourant with cut tobacco cigarette filler and then to feed the thus obtained mixture to a cigarette rod making machine. It was the proposition of U.S. Pat. No. 5,450,863 to adhere a particulate burn rate substance to adhesive printed on cigarette paper, such that the substance adheres to the paper in accordance with the printed pattern of the adhesive. The cigarette paper so loaded with burn rate modifying substance is then used on a rod making machine for the purpose of making continuous tobacco rod. As will be apparent to those skilled in the art, the proposed method of U.S. Pat. No. 5,450,863 could be used in respect of the incorporation of a particulate smoke-modifying agent in a tobacco rod. It is a teaching of U.S. Pat. No. 4,409,995 that particulate material is deposited on tobacco rod via a bore extending through the garniture tongue of a rod making machine.

It is an object of the subject invention to provide an improved and commercially practical method of incorporating a particulate smoke-modifying agent in a smoking material rod.

The subject invention provides a method of incorporating particulate smoke-modifying agent in a smoking material rod, wherein said agent is introduced into a flow of filamentary smoking material to the suction band of a rod making machine, the location of introduction being in the vicinity of the suction band of said machine and the particulate smoke-modifying agent being conveyed to said location of introduction and being introduced into the flow of smoking material by way of being entrained in a flow of gaseous medium.

By preference the gaseous medium is air.

Preferably, the location of introduction of the smoke-modifying agent into the flow of filamentary smoking material to the suction band of the rod making machine is at the suction band guide rails. Suitably, the path of introduction of the smoke-modifying agent into the flow of smoking material extends through one of the two guide rails. Alternatively, the path of introduction of the smoke-modifying agent extends through a wall bounding a chimney of a rod making machine and extends vertically, or substantially vertically, within the chimney.

Preferably, the location of the introduction of the smoke-modifying particles relative of the width of the curtain of filamentary smoking material flowing to the suction band is such that the particles are deposited on smoking material which has already been deposited on the suction band, and downstream of the said location, further smoking material of the curtain is deposited over the deposited particles, so as to ensure that the particles are other than at the periphery of the smoking material carpet as finally formed at the downstream end of the lower run of the suction band. Suitably, the said location is at a mid zone of the said curtain of smoking material. Thus, for example, the said location may be situate between about 25% and about 60% of the width of said curtain taken from that end thereof from which smoking material is first deposited on the suction band, and preferably between about 25% and about 40%. The advantages of the said location of the introduction of smoke-modifying particles being at a mid zone of the said curtain of smoking material include the minimisation of losses in respect of the smoke-modifying particles passing through the suction band, a better smoking article product wherein loss of smoke-modifying agent to sidestream smoke is minimised, and the maintenance of smoke-modifying particles in the smoking article without substantial loss.

Advantageously, the rate of flow of the smoke-modifying agent to the location of introduction is adjustable relative to the speed of operation of the rod making machine, i.e. with any changes in the flow rate of the smoking material to the suction band, such that the smoke-modifying agent is incorporated at a uniform mass quantity per unit length of the smoking material rod. The smoke-modifying agent may, as a result of employment of the subject invention, be present in the smoking material rod at, for example, 10 to 20 mg per smoking article unit length of the rod, 16 mg for instance.

As an alternative to the flow of smoke-modifying agent to the location of introduction being a continuous flow, the flow may be intermittent, so that in smoking article rods, the product of said machine, the smoke-modifying agent is located at a zone thereof, which zone extends over a fraction only of the length of the rod, at that zone, for example, which accounts for the last few puffs, the last two or three say, in the smoking of a smoking article comprising the rod.

The particulate smoke-modifying agent may comprise, for example, tobacco dust or encapsulated flavourant, menthol for example. In the former case the tobacco dust may be impregnated with a flavourant.

The smoke-modifying agent particles are preferably of spherical shape. The particles may, for example, be of a diameter from about 0.5 mm to about 1.0 mm. The particles used in any particular instance are preferably of uniform diameter. The particles should not be inter-adherent, but on the contrary a bulk of the particles should be free-flowing.

The subject invention further provides a smoking material rod making machine comprising a suction band, filamentary smoking material feed means and smoke-modifying agent feed means, the smoking material feed means being operable to provide a flow of filamentary smoking material to the suction band, the smoke-modifying agent feed means being operable to introduce smoke-modifying agent into said flow, the location of introduction into said flow being in the vicinity of said suction band, and said particulate smoke-modifying agent being conveyed to said location and being introduced into said flow of filamentary smoking material by said smoke-modifying agent feed means by way of said particulate smoke-modifying agent being entrained in a flow of gaseous medium.

In order that the subject invention may be clearly understood and readily carried into effect, reference will now be made, by way of example, to the diagrammatic drawings herewith, in which.

Figure 1:
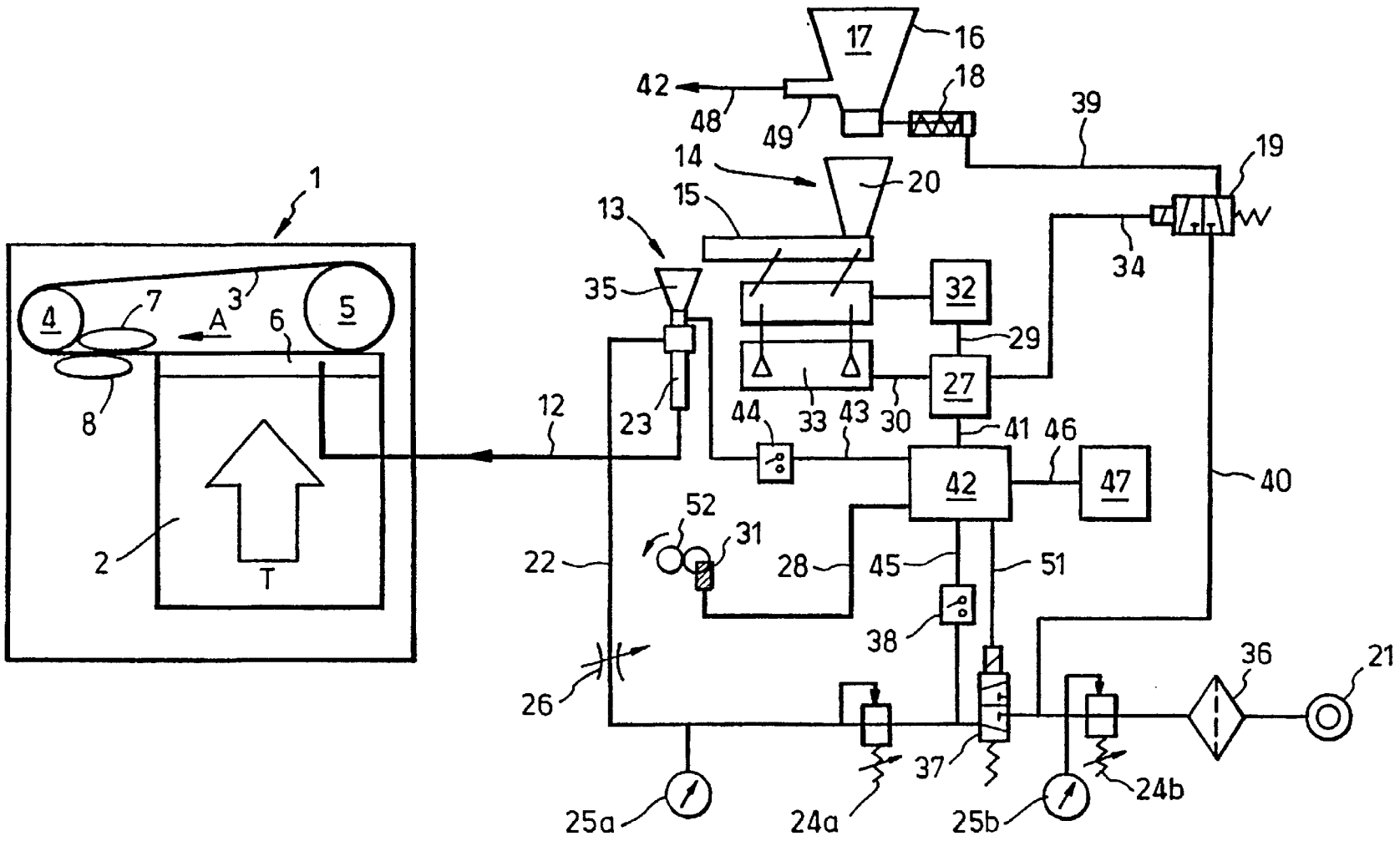
FIG. 1 shows parts of a cigarette rod making machine and associated equipment.

In FIG. 1 of the drawings herewith parts of a cigarette rod making machine are designated generally by reference numeral 1. The making machine 1 comprises the well known features of an upwardly extending tobacco-feed chimney 2, a foraminous, metallic suction band 3 trained about rollers 4 and 5 (one of which is a drive roller), a trough guide 6 and ecreteurs 7 and 8.

In operation of the making machine 1, filamentary cut tobacco filler is fed continuously to the lower end of the chimney 2 by conventional feed means (not shown) of the machine 1 and flows upwardly within the chimney 2 (as indicated by arrow T) in an air flow which is maintained under the action of a vacuum which is maintained above the foraminous suction band 3. At the trough guide 6 the filler is deposited on the under side of the lower run of the suction band 3 and is transported, as a carpet on the band 3, forwards (leftwards viewing FIG. 1, i.e. in the direction of arrow A) to the location of the ecreteurs 7 and 8, which serve to trim filler from the carpet. As is well known to those skilled in the tobacco art, downstream of the ecreteurs 7 and 8 the tobacco carpet is fed into a garniture (not shown) of the making machine 1 under the action of a transporting garniture band (also not shown) which acts in addition to feed a continuous web of cigarette paper to the garniture. The garniture serves to enwrap the tobacco in the cigarette paper web to provide a continuous tobacco rod. Signals from a rod density monitoring means (also not shown) downstream of the garniture cause position changes of the ecreteurs 7 and 8 such that the amount of tobacco trimmed from the carpet on the suction band 3 is that requisite to maintain the density of the cigarette rod within specified tolerance limits.

Figure 2:
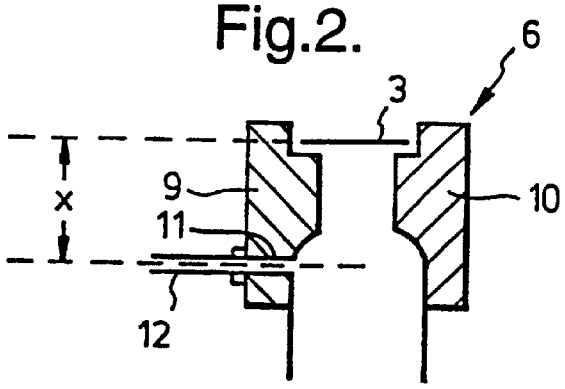
FIG. 2 shows a transverse section, to an enhanced scale, of a first arrangement taken at a trough guide of the making machine of FIG. 1.
Figure 3:
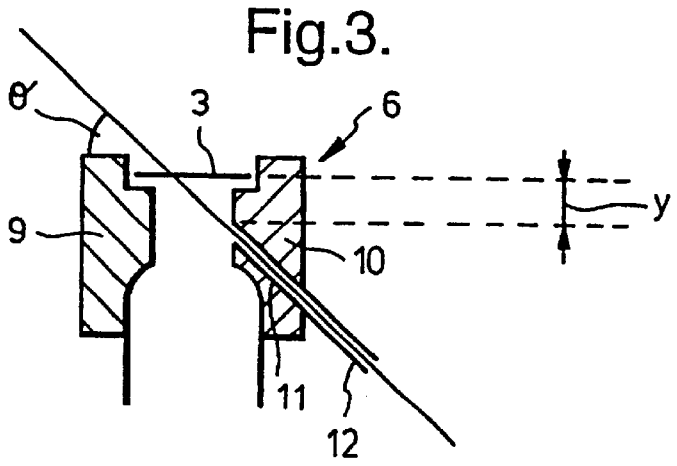
FIG. 3 shows a transverse section, to an enhanced scale, of a second arrangement taken at a trough guide of the making machine of FIG. 1.

As is indicated by FIGS. 2 and 3, the trough guide 6 may comprise first and second suction band guide rails 9 and 10. Extending through a guide rail 9 or 10 is a bore 11, which bore 11 is in air flow communication with a delivery tube 12 of a capsule delivery unit which in FIG. 1 is designated generally by reference numeral 13. The bore 11 may extend through the guide rail 9 or 10 either horizontally, or substantially horizontally, (as depicted in FIG. 2) or the bore 11 may extend through the guide rail 9 at an angle θ to the horizontal (as depicted in FIG. 3). The angle θ may be, for example, about 30°. The vertical distance between the centre line of the bore 11, when the bore 11 extends horizontally, or substantially horizontally, through the guide rail 9 or 10, and the underface of the suction band 3 is 20 mm (depicted in FIG. 2 as x). The vertical distance between the upper surface of the bore 11, when the bore 11 extends through the guide rail 9 or 10 at an angle of about 30°, and the underface of the suction band 3 is 6 mm (depicted in FIG. 3 as y).

Figure 4:
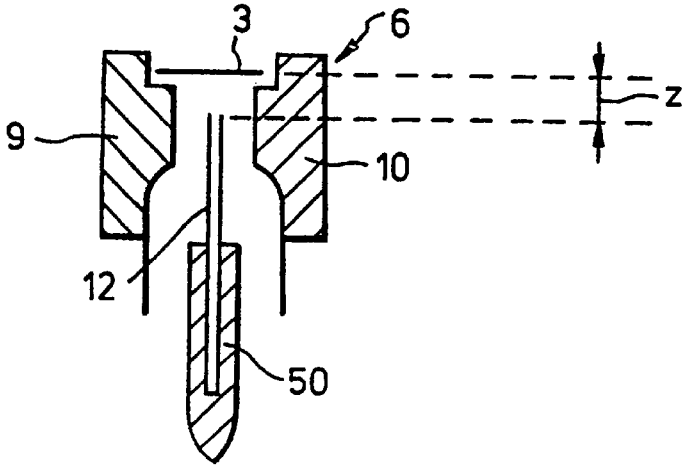
FIG. 4 shows a transverse section, to an enhanced scale, of a third arrangement taken at a trough guide of the making machine of FIG. 1.

FIG. 4 shows that the trough guide 6 may alternatively comprise a delivery tube 12 which extends vertically, or substantially vertically, (as viewing FIG. 4) within the chimney 2 and trough guide 6. The vertical distance between the outlet end of the delivery tube 12 and the underface of the suction band 3 is 10 mm (depicted in FIG. 4 as z). In order to prevent gas/tobacco flow disruptions in the chimney a suitably shaped deflector 50 is positioned about the lower end of the delivery tube 12. As will be apparent to those skilled in the art transfer means, for example a brush wheel feeder (not shown), may be positioned at the lower end of delivery tube 12 in order to aid in the acceleration of smoke-modifying agent capsules along the vertical, or substantially vertical, tube 12.

In FIG. 1 reference numeral 14 designates generally a capsule feed unit comprising a vibratory, gravimetric feeder 15 (which may be a K-Tron (Trade name) KCL24-KV1 feeder) and a refill device 16. The device 16 comprises a hopper 17 and a pneumatic valve 18, which valve 18 is operable, under action of a control valve 19, via an air line 39, to convey smoke-modifying agent capsules from the hopper 17 to an infeed hopper 20 of the vibratory feeder 15. The control valve 19 is supplied with air via an air supply line 40.

The capsule delivery unit 13 comprises a source 21 of pressurised air, an air line 22, extending from the air source 21 to a pneumatic material transfer unit 23, and the aforesaid delivery tube 12. The delivery tube 12 intercommunicates the transfer unit 23 and the aforesaid bore 11 in the suction band guide rail 9 or 10. The pneumatic material transfer unit 23. may alternatively be a venturi capsule injector.

In the air line 22 are two pressure regulators 24*a* and 24*b* , two pressure gauges 25*a* and 25*b* , and an adjustable flow restrictor 26. The pressure regulator 24*a* is operable to control air pressure to the transfer unit 23 and the pressure regulator 24*b* is operable to control the air pressure entering the system . Further, a filter 36 is positioned in the air line 22 to remove air contaminants from the incoming air. A valve 37 positioned in the air line 22 is operable to allow or prevent air flow within air line 22 to the pneumatic material transfer unit 23.

Reference numeral 42 designates a Programmable Logic Controller (PLC), for example a PLC as manufactured by Allen Bradley model no. SLC500. The PLC is interconnected by signal transmission lines 41, 43, 28, 45, 46, 48 and 51 respectively, with a microprocessor 27, a vacuum switch 44, operable to detect a blockage within the capsule delivery unit 13, an encoder 31, an air pressure detector 38, operable to detect air pressure in air line 22, a man-machine-interface (MMI) unit 47, operable to allow operator input into the system and to display system status, a level sensor 49 of the hopper 17 of the refill device 16, and the aforementioned valve 37.

The microprocessor 27 is interconnected by signal transmission lines 41, 29 and 30 respectively with the PLC 42, drive means 32, operable to drive the vibratory feeder 15, and a weighbridge 33 of a capsule feed unit designated by reference numeral 14. The microprocessor 27 is also interconnected, by signal transmission line 34, to the control valve 19 of the conveyor 18 of the refill device 16.

The encoder 31, which is interconnected with the drive shaft 52 of the rod making machine 1, is operable to generate a signal representative of the current speed of operation of the rod making machine 1.

When the rod making machine 1 is in operation, the capsule delivery unit 13 and the capsule feed unit 14 are operable in conjunction to provide a uniform, continuous and non-pulsed introduction of smoke-modifying agent capsules, through the delivery tube 12, to the upward flow of cut tobacco filler to the suction band 3.

In operation of the capsule delivery unit 13 a uniform air flow is established from the pressurised air source 21, via the line 22 and the transfer unit 23, to and through the delivery tube 12. Smoke-modifying agent capsules are fed, at a rate accurably controlled by the capsule feeder unit 14, to the transfer unit 23 via a hopper 35 thereof, whereupon the capsules are entrained in the air flow and are thus conveyed to and through the delivery tube 12. Upon emerging from the delivery tube 12 (and the bore 11, if applicable), the capsules become entrained in the upwardly directed tobacco-conveying air flow and travel with the tobacco filler to the moving suction band 3.

As is indicated in FIG. 1, the location of the introduction of the capsules is at a mid zone of the chimney 2. This ensures that the capsules are deposited on tobacco filler which has already built up on the suction band 3 upstream of the said location of capsule introduction. As the deposited capsules move forward with the band 3 further deposition of the upwardly flowing filler results in the capsules being located generally centrally of the depth of the filler carpet which passes forwardly to the aforementioned garniture of the rod making machine 1. This in turn means that the capsules are located generally centrally of the rod formed in the garniture. The capsules are also distributed evenly lengthwise of the rod.

The PLC 42 is operable to ensure that the capsule feed unit 14 feeds capsules to the capsule delivery unit 13 at the feed rate which, relative to the speed of operation of the rod making machine 1, is that required to attain the specified weight of capsules per unit rod length, which specified weight is selected by the operator via the MMI unit 47.

What is claimed:

1. A method of incorporating non inter-adherent, free flowing, particulate smoke-modifying agent in a smoking material rod, wherein said agent is introduced into an air entrainment flow of filamentary smoking material to a suction band of a rod making machine, the location of introduction of said agent into said flow being in the vicinity of said suction band and said agent being conveyed by means of a flow of a gaseous medium to said location and being introduced into said flow at said location by way of said agent being entrained in the flow of gaseous medium.

2. A method according to claim 1, wherein said location of introduction is at the suction band guide rail of said machine.

3. A method according to claim 2, wherein the path of introduction of the smoke-modifying agent extends through one of the said guide rails.

4. A method according to claim 1, wherein a path of introduction of the smoke-modifying agent extends through a wall bounding a chimney of said rod making machine and extends vertically, or substantially vertically, within said chimney.

5. A method according to claim 1, wherein said location is situated between about 25% and about 60% of a length of a deposit of said smoking material on said suction band in register with said flow of smoking material to said band taken from an upstream end of said deposit.

6. A method according to claim 5, wherein said location is situated between about 25% and about 40% of said length.

7. A method according to claim 1, wherein a rate of flow of said particulate smoke-modifying agent to said location is adjustable relative to a speed of operation of said rod making machine.

8. A method according to claim 7, wherein said rate of flow of said particulate smoke-modifying agent to said location is adjusted in accordance with any changes in the flow rate of said filamentary smoking material to said suction band.

9. A method according to claim 7, wherein said rate of flow of said particulate smoke-modifying agent to said location is such that the smoke-modifying agent is incorporated at a uniform mass quantity per unit length of said smoking material rod.

10. A method according to claim 9, wherein said uniform mass quantity per unit length of said smoking material rod is 10 to 20 mg per smoking article unit length of the rod.

11. A method according to claim 1, wherein said entrained flow of said particulate smoke-modifying agent in said gaseous medium is intermittent, so that in each smoking article rod produced by said machine the smoke-modifying agent is located at a zone thereof, which zone extends over a fraction only of the length of the rod.

12. A method according to claim 11, wherein said zone of said rod is that zone which accounts for the last few puffs in the smoking of a smoking article comprising said rod.

13. A method according to claim 1, wherein said particulate smoke-modifying agent comprises encapsulated flavourant.

14. A method according to claim 13, wherein said encapsulated flavourant is menthol.

15. A method according to claim 1, wherein said particulate smoke-modifying agent comprises tobacco dust.

16. A method according to claim 15, wherein said agent further comprises a flavourant.

17. A method according to claim 1, wherein the smoke-modifying agent particles are spherical.

18. A method according to claim 17, wherein said smoke-modifying agent particles have a diameter of about 0.5 mm to about 1.0 mm.

19. A method according to claim 17, wherein said smoke-modifying agent particles are of uniform diameter.

20. A method according to claim 1, wherein the smoke-modifying agent particles in bulk are free-flowing.

21. A smoking material rod making machine comprising a suction band, filamentary smoking material feed means and smoke-modifying agent feed means, the smoking material feed means being operable to provide an air entrainment flow of filamentary smoking material to the suction band, the smoke-modifying agent feed means being operable to introduce non inter-adherent, free-flowing, particulate smoke-modifying agent into said flow, the location of introduction of said agent into said flow being in the vicinity of said suction band, and said smoke-modifying agent feed means comprising a pneumatic transfer unit, a gaseous medium supply means, a delivery tube, extending from said transfer unit to said location, and a feed unit, said feed unit being operable to feed a continuous supply of said agent to said transfer unit, said supply means being operable to supply continuously gaseous medium to said transfer unit and through said delivery tube to said location, and said transfer unit being operable to entrain said agent in a thus established flow of said gaseous medium in said delivery tube, whereby in operation of said machine said agent is conveyed to said location by entrainment thereof in said flow of said gaseous medium.

* * * * *